United States Patent [19]

Castoldi

[11] 3,937,172

[45] Feb. 10, 1976

[54] WATER JET PROPELLING APPARATUS FOR BOATS

[76] Inventor: Luigi Castoldi, 161 Viale Mazzini, 20081 Abbiategrasso, Italy

[22] Filed: May 22, 1974

[21] Appl. No.: 472,379

[30] Foreign Application Priority Data

May 25, 1973 Italy ..... 24624/73

[52] U.S. Cl. ..... 115/12 R

[51] Int. Cl.[2] ..... B63H 11/00

[58] Field of Search ..... 115/11, 12 R, 14, 15, 16; 60/222; 114/162, 163

[56] References Cited

UNITED STATES PATENTS

| | | | |
|---|---|---|---|
| 3,114,239 | 12/1963 | Aylor | 115/16 |
| 3,422,789 | 1/1969 | Wynne et al. | 60/222 |
| 3,465,705 | 9/1969 | Castoldi | 115/12 R |

*Primary Examiner*—Trygve M. Blix
*Assistant Examiner*—Jesus D. Sotelo
*Attorney, Agent, or Firm*—Michael J. Striker

[57] ABSTRACT

A water jet propelling apparatus for boats forces waters by a pump through a nozzle directed astern of the boat. A curved lowerable jet-deflecting surface downwardly and forwardly deflects the water and reverses the thrust; and a pair of steerable parallel rudder blades are pivotable in unison for laterally deviating the jet. The jet-deflecting surface has symmetrical channel-like side portions which directs water escaping laterally from the clearance between the trailing edges of the rudder blades and the jet-deflecting surface forwardly towards the bow to enhance the reverse thrust, and a central portion which is complementally shaped with the welder blades for maintaining the clearance with the latter constant for various pivotal deviations of the blades.

8 Claims, 14 Drawing Figures

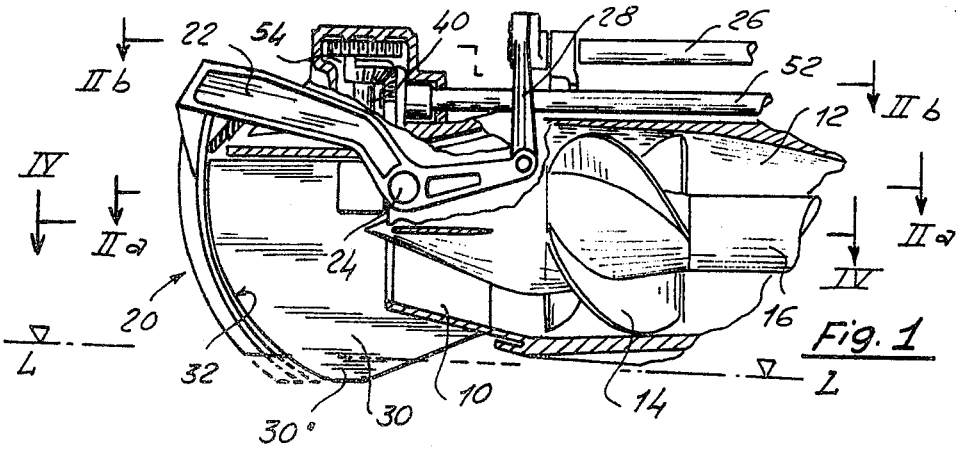
Fig. 1
Fig. 2A
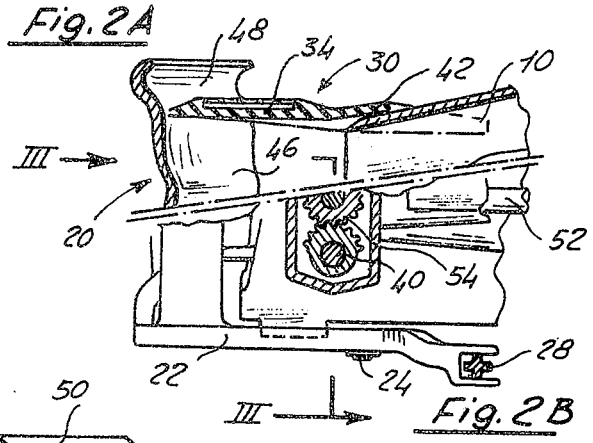
Fig. 2B
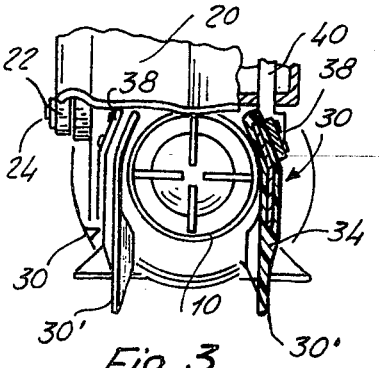
Fig. 3
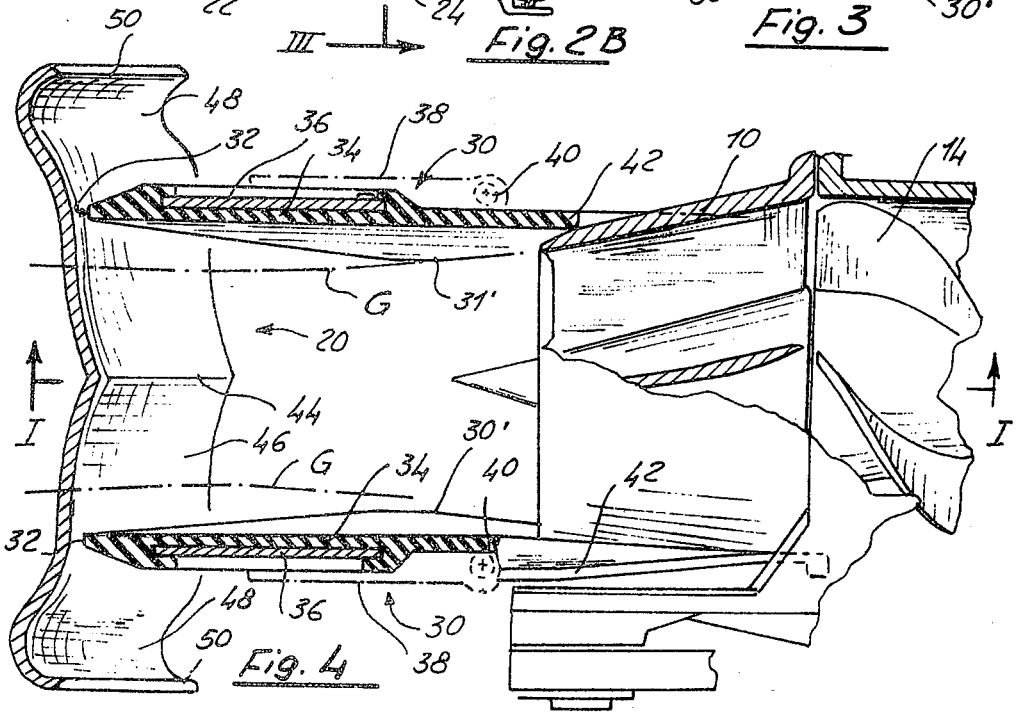
Fig. 4

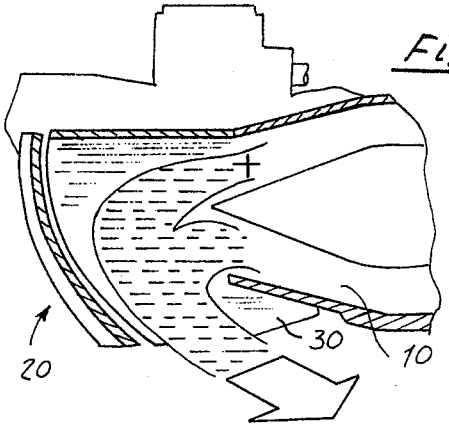
Fig. 5
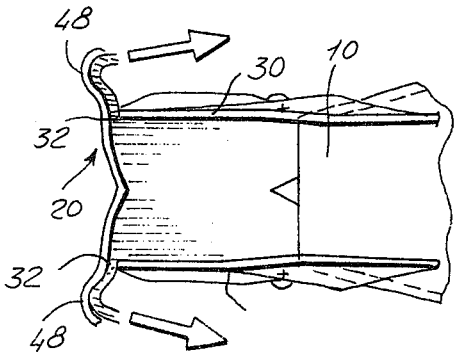
Fig. 6
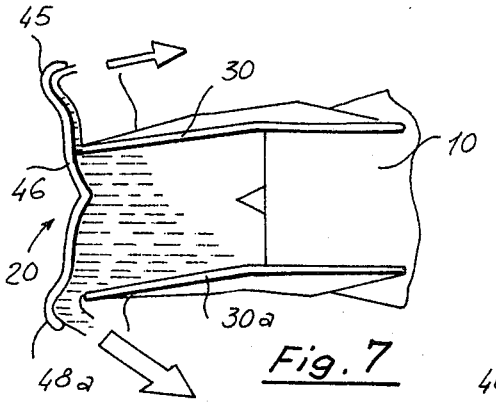
Fig. 7
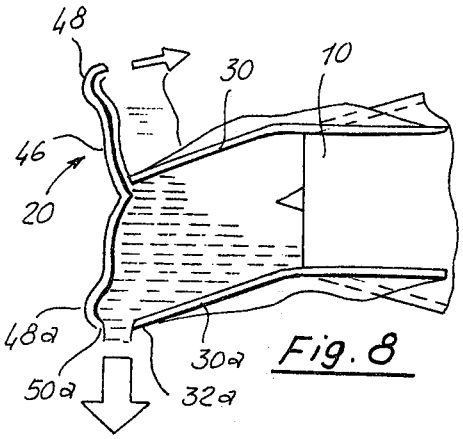
Fig. 8
Fig. 9
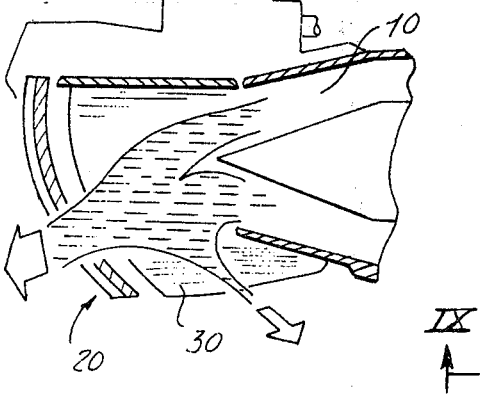
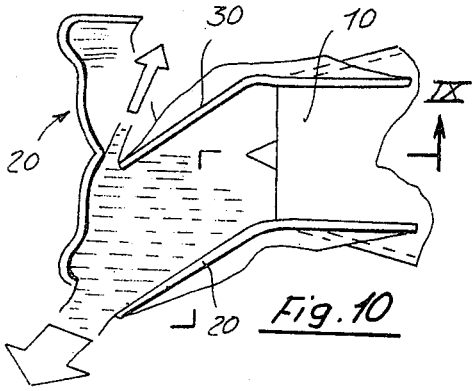
Fig. 10

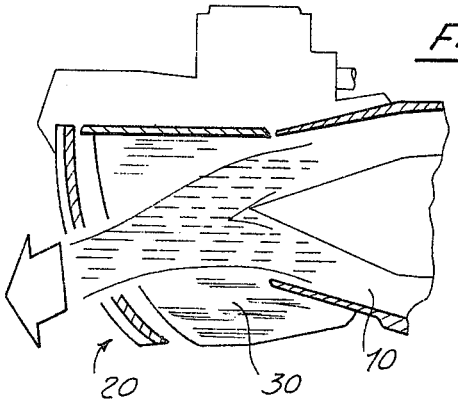
Fig. 11
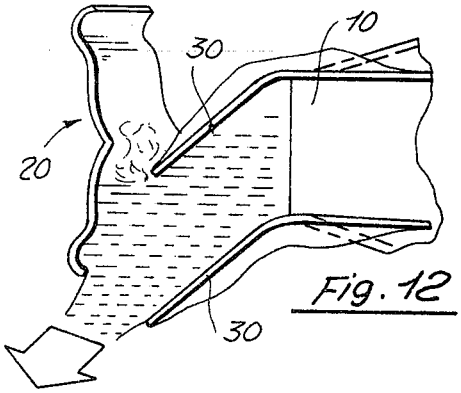
Fig. 12
Fig. 13
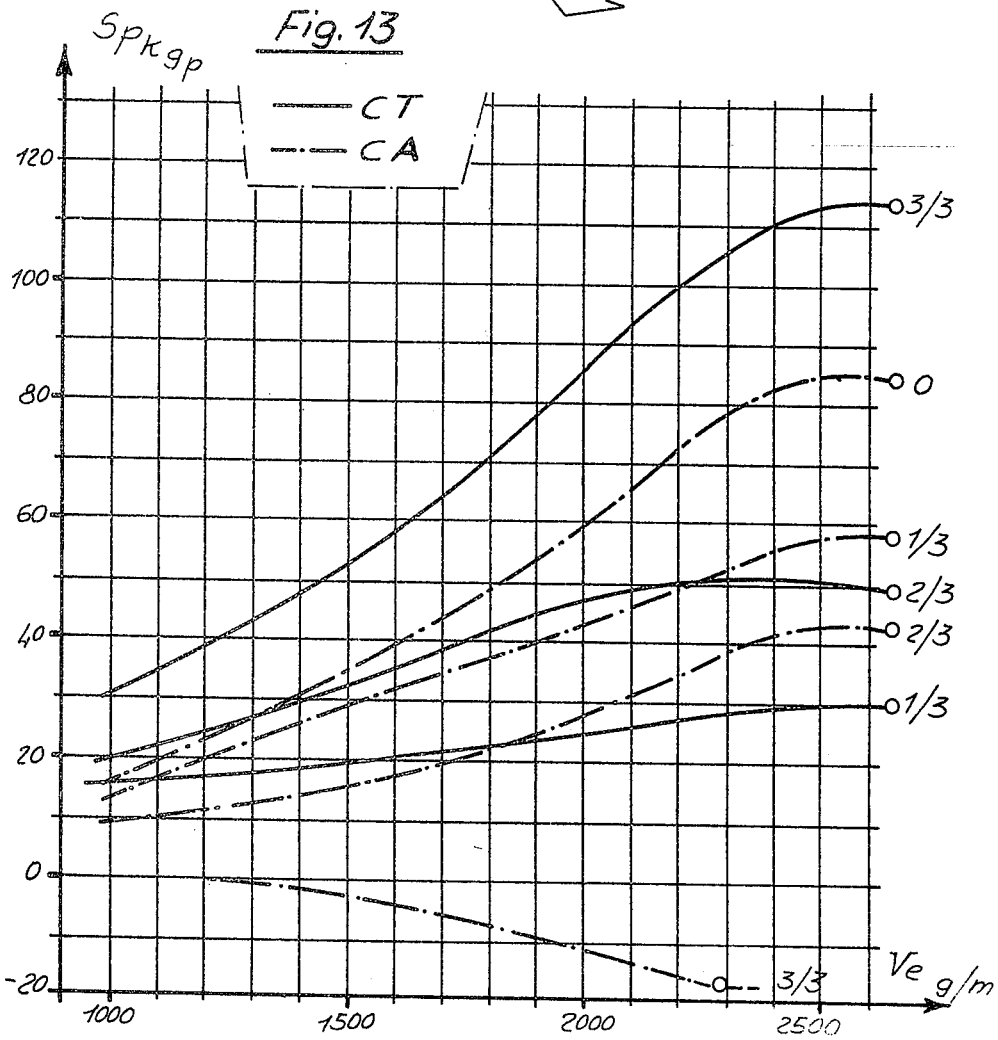

WATER JET PROPELLING APPARATUS FOR BOATS

BACKGROUND OF THE INVENTION a. The Field of the Invention

This invention relates to marine propulsion apparatus of the type comprising a rearwardly directed jet orifice connected to pumping means which is adapted to take water from outside a boat or the like vessel with which said marine propulsion apparatus is associated and to discharge a jet of water into the air astern of the vessel from said jet orifice in a manner such as to drive the boat or the like vessel.

b. The prior Art

At present these marine propulsion apparatus are associated with means comprising some form of deflecting device including a direction of travel control member so shaped and mountable that it can be interposed in the path of the jet of water for deflecting such jet forward and thus causing the boat to go astern, and the control member can be removed completely from the path of the discharged jet of water to allow said jet to propel said boat forwardly. Further, some laterally deflecting device, generally one or more swingable rudder blades or a laterally swingable tube means, is provided for selectively deflecting said jet of water leftwardly or rightwardly of the longitudinal plane of symmetry of the boat for directionally controlling and altering the course of the boat. Still further, the pumping means are actuated by some suitable source of power, generally an internal combustion engine provided with conventionally operated throttle means, whereby the power applied to said pumping means and consequently the speed of ejection and the rate of flow of the jet can be adjusted. Therefore, by operating suitable control means, the boat or like vessel to which a marine propulsion apparatus of the kind referred to above is associated, can be governed at will, either as to its speed, course and/or direction.

It is however well known to those skilled in the art that any marine propulsion apparatus of the kind referred to above, more generally and simply termed "water jet units", while very satisfyingly operating for regular forwardly directed thrust, that is when the water jet is neither intercepted nor deviated (the advantages of such water jet units for marine propulsion, particularly for relatively small boats, are so widely known that further comments are unnecessary), provide an undesirably poor control and efficiency when the boat is performing sharp radius turns and a still less efficient and poorer response during low speed maneuvers, principally when the boat is in reverse. The improved apparatus described and shown in my prior U.S. application Pat. No. 3,465,705 and in the British Patent Specification No. 1,204,794 has provided a more satisfying control in low speed maneuvers but the efficiency of propulsion when maneuvering in reverse is not as high as is desired.

The fact that principally leads to the above and other objectionable characteristics in the efficiency of the known water jet propulsion units for boats consists of the excessive turbulence and the partial and irregular re-direction of the water which is flowing from the jet opening at considerable velocity.

It is therefore an object of this invention to provide water flow control means for controlling the motion of a boat having a marine propulsion apparatus of the water jet type, which will obviate or at least drastically minimize the foregoing and other difficulties and limitations.

BRIEF SUMMARY OF THE INVENTION

According to the invention, the new marine propulsion device has a nozzle structure which cooperates with pumping means which is adapted to issue a pressurized water jet that is capable of applying a forwardly directed thrust to the boat, said nozzle structure having a discharge orifice; a generally bucket-like deflector pivotally connected to said nozzle structure for adjustable movement about a horizontal axis transversal to and above the axis of said jet from a raised position wherein said deflector is fully above said jet to a lowered position wherein said deflector fully intercepts said jet at a distance from said discharge opening and from said horizontal axis; a pair of laterally spaced steerable rudder blades at opposite sides of said jet which are pivotally connected to said nozzle structure for concurrent swinging movement about parallel vertical axes near to said discharge opening and of such shape to essentially close laterally the space comprised between said discharge orifice and the deflector when fully lowered; the said deflector comprising a center portion the transverse width of which corresponds to the spacing of said rudder blades and being shaped so that its cross-sections in each vertical plane parallel to the axis of the jet form circular arcs having their centers in said horizontal axis, and its transverse sections in planes containing said latter axis form circular arcs symmetrical to the vertical plane of symmetry of said jet and having their centers in said axes of said rudder blades; the deflector also comprising side portions external to said center portion and shaped so that their cross-sections in said planes containing said horizontal axis form forwardly concave essentially semi-circular arcs.

These and other features of the new propulsion apparatus and the important advantages resulting therefrom will be best understood from the following detailed description of a preferred embodiment of the invention, when considered together with the accompanying drawings.

BRIEF DESCRIPTION OF THE VIEWS OF THE INVENTION

FIG. 1 is partly a side view and partly a cross-sectional view, taken in the vertical plane of symmetry, indicated at I—I in FIG. 4, of the rear part of the apparatus embodying the concepts of the invention;

FIGS. 2A and 2B are fragmentary cross-sectional views, illustrating nearly symmetrical side portions of said apparatus, taken in the horizontal planes indicated at II*a*—II*a* and respectively at II*b*—II*b* FIG. 1;

FIG. 3 is partly a rear view and partly a cross-sectional view taken in the plane III—III in FIGS. 2A and 2B, and illustrating the apparatus having its deflector fully raised;

FIG. 4 is a longitudinal cross-sectional view of the apparatus of FIG. 1, taken in the plane indicated at IV—IV in FIG. 1 and illustrating certain essential components of the apparatus in larger scale and greater detail;

FIG. 5 is a diagrammatic view of the apparatus of FIG. 1 and illustrates the effects of the reverse of the water jet for causing the boat to travel straight rearwardly;

FIG. 6 is a similarly diagrammatical illustration of the apparatus as shown in FIG. 2A and adjusted for providing the above effects;

FIG. 7 is a view similar to that of FIG. 6, but illustrates the effects of a relatively small lateral deviation of the rudder blades, when the deflector is set to reverse the jet, for performing a curve while going rearward;

FIG. 8 is another view similar to that of FIG. 6, but illustrating the rudder blades at a greater lateral deviation and the effects resulting therefrom;

FIGS. 9 and 10 are views similar to those of FIGS. 5 and 6, and illustrating a still greater lateral deviation of the rudder blades and the resulting effects;

FIGS. 11 and 12 are views similar to those of FIGS. 9 and 10 and illustrate the effects of an exaggerated lateral deviation of the rudder blades; and FIG. 13 is a graph including several curves indicating the variation of the transverse component (CT) and of the longitudinal component (CA) of the thrust resulting from the deviated water jet, as a function of the deviation of the rudder blades, the curves being plotted for zero deviation, and for deviations of one-third, of two-thirds and of three-thirds of the practical maximum positional deviation, said thrust being indicated in terms of Kilograms ($Sp_{kg}$ ) for various velocities (Ve) in terms of revolutions per minute (g/m) of the pump rotor, in a conventional pump-motor assembly, associated with a water jet unit according to the invention and as shown in FIGS. 1 to 4.

DETAILED DESCRIPTION OF THE PREFERRED EMBODIMENT

Referring firstly to FIGS. 1 to 4, there is shown a nozzle structure 10 which forms the outlet portion of a duct 12 having a conventional inlet (not shown) in the bottom of the boat and wherein a pumping means including a screw impeller 14 is secured to the rear end of a drive shaft 16 which is conventionally connected at its fore end to a suitable engine or motor (not shown). When operated, this assembly provides a water jet issuing rearwardly of the boat from the discharge opening of the nozzle 10, the path of said jet, if not intercepted and not disturbed, being defined by the axis of the nozzle 10.

The apparatus is provided with a generally bucket-shaped deflector or reversing gate means having a jet-deflecting surface 20 and which will be discussed in detail below. Said deflector is supported by means of two symmetrical braces 22 for pivotal movement about horizontal pivotal axles 24 with respect to the nozzle structure 10, said axles 24 defining a horizontal transversal axis above the axis of the nozzle. A suitable control mechanism including a shaft 26 and a link 28, or other conventional transmission means leading to steering means, is provided for control of the position of the deflector, at the command of the helmsman, from a lowermost position (that of FIG. 5) to an uppermost position (not shown) completely above the jet which issues at noticeable speed from the discharge opening of the nozzle. The arrangement and the action of such deflector, in its broadest terms, are known and further comments are unnecessary.

A substantial interval exists between the nozzle discharge orifice and the deflector 20, when lowered, and the fore surface of the deflector defines the rear wall for a space thus formed in said interval. In FIGS. 1, 5, 9 and 11 there is shown that such surface is curved and that its cross-sectional configuration, in vertical planes parallel to the axis of the nozzle, includes circular arcs having their center in the horizontal axis defined by axles 24. The same space is laterally defined by symmetrical rudder blades 30, the trailing or rear edges of which, indicated at 32 in FIGS. 1 and 4, have a similar arc-shaped configuration and form a little clearance (such as few millimeters) with said fore surface of the deflector.

Preferably, the rudder blades 30 extend downwardly a little below the plane L—L defining the plane of the bottom of the and below the discharge opening of the nozzle and assist the rudder steering effect at high speed and large radius curves, but cutting through the water, while the water jet is advantageously unaffected by the small deviation of said rudder blades at said high speed. The lateral limits of the undisturbed jet are indicated by dot-and-dash lines G in FIG. 4. The lowest portion 30′ of said rudder blades is preferably resilient and, most preferably, said rudder blades are formed by shaped rudder plates 34 secured about stiffening metal or plastic plates 36 secured to or integrally formed with braces 38 secured to vertical shafts 40 which define two parallel vertical axes located at opposite sides of the nozzle structure 10. Said rudder plates are made of rubber or of rubbery material for providing substantial resiliency and are integrally formed with forward extensions 42 which embrace the nozzle structure 10. The plates are supported and formed to provide a channel therebetween for the water jet.

The concurrent lateral deflection of the rudder blades 30 is controlled by a suitable mechanism. Such mechanism may include, for example, a gearing 54 (FIGS. 1 and 2B) connecting said axles 40 to a shaft 52 which at its turn is suitably connected to the helm means (not shown) of the boat.

Additionally to its arc-shape configuration in its vertical cross-sections, the deflector 20 has a characteristic configuration in its cross-sectional sections taken in planes containing the said horizontal axis defined by axles 24 about which the deflector can be raised and lowered at helmsman's command. Such characteristic configuration is shown in FIGS. 2A, 6 to 8 10, 11 and in greater detail in FIG. 4. This configuration is symmetrical relatively to the vertical plane containing the axis of the nozzle (corresponding to the plane indicated at I—I in FIG. 4) and has a shallow dihedral apex 44 (FIG. 4) in such plane.

Adjacent to and at both sides of said dihedral apex 44, the said deflector 20 has a central portion comprised of two curved concave surfaces 46 which are curved according to arcs having their centers nearly in the axes of said axles 40 of the corresponding side, said curved surfaces extending from said apex 44 until they are facing the trailing edges 32 of the rudder blades, so that the clearance between said surfaces 46 and the blades, when inwardly deflected, is nearly constant, until the deflection does not pass beyond the apex 44 (that is from the position of FIGS. 2A, 4 and 6 to that of FIG. 8 about).

Outwardly of said trailing edges 32 (when the rudder blades 30 are straight, that is set for straight course of the boat, FIGS. 2A, 4 and 6), the deflector 20 comprises channel-shaped side portions 48 having their concavities forwardly facing and having curved side edges 50 positioned to provide a substantial clearance with the trailing edge of the rudder blade when set in substantial longitudinal alignment, as shown in FIG. 8, where the so located channel portion, side edge, rudder blade and trailing edge are indicated at 48*a*, 50*a*, 32*a* and 30*a*, respectively, in order to facilitate the description of the resulting effects.

The description of the propulsion unit for regular forward motion of the boat (that is when the deflector 20 is fully raised above the water jet) is omitted, as being well known. The various effects resulting by variously lateral deflecting of the rudder blades will be now briefly described, with reference to FIGS. 5 to 12 inclusive. In said Figures part of the water issued from the nozzle and variously and selectively deviated by various control members (deflector and rudder blades) is indicated by a horizontal hatching. In same Figures some arrows are indicated to visualize the streams of water flowing from between said parts and components of the apparatus. The thickness of such arrows indicates, in a very approximate manner, the proportionality of the rate of flow of such stream.

Assuming that the deflector is fully lowered and the rudder blades are set for straight course (that is parallel to the axis of the jet), as shown in FIGS. 3 to 6, nearly the entire amount of the water jet is reversed, that is directed forward of the boat. The most of the water is downwardly and then forwardly deviated by the deflector (FIG. 5) and the non-negligible portion of the flow which escapes through the unavoidable clearance between the deflector and the rudder blades' trailing edges 32 is symmetrically laterally and then forwardly deviated by the channel-shaped side portions 48 of the deflector, as shown in FIG. 6.

Essentially the entire energy of the jet is efficiently used for reverse thrusting the boat, and essentially no lateral energy wasting thrusts are caused to occur. This high efficiency characteristic is illustrated by curve 0 of the graph of FIG. 13. Such efficiency is very important because a valuable reverse thrust can be had even if the engine is set nearly at idle for good and safe maneuvering at low speed. It is known that conventional water jet propulsion units require that the engine must be markedly accelerated in order to achieve a satisfactory reverse thrust. This acceleration means waste of power, perturbance of the water, poor maneuvering and even a safety hazard when the control of the throttle is not operated substantially simultaneously with the deflector; because the raising of the deflector when the engine is running at high output speeds leads to an unexpected forward acceleration of the boat.

By slightly deviating the rudder blades, for example towards the right (FIG. 7) the spacing between the outwardly deviated right blade 30*a* and the corresponding part 48*a* of the deflector increases, while that between the opposite left blade and its opposite part remains constant, owing to the curvature of the surface portion 46 of the deflector. The lateral flow of water increases at the right side while the downwardly deviated flow proportionally decreases. An asymmetry of lateral thrust occurs for proper steering of the boat in reverse, while all thrusts provided by the several flows contribute for moving the boat at reverse or astern, for gentle turning of the boat at reverse. The turn can be sharpened by a greater deviation of the rudder blades, as shown in the position of FIG. 8.

The curves 1/3 and 2/3 of the graph indicate that either good longitudinal (dot-and-dash line) or good lateral (full line) thrusts are obtained, for sharp radius turns in reverse, and also when the motor is throttled down for careful and slow maneuvers.

A further deviation of the rudder blades, up to the practical maximum position (FIGS. 9 and 10), provides the most important result of turning the boat "on the spot". The various forward and rearward flows provide a nearly perfect balance of the longitudinal thrusts (see the curve 3/3 in dot-and-dash line of the graph) while a substantial sidewardly directed thrust is obtained, even at idle (the rearwardly directed flow shown in FIG. 9 is to be imagined as passing laterally of the deflector, as shown in FIG. 10).

A generally excessive lateral deviation of the rudder blades, such as shown in FIGS. 11 and 12, can be used by experienced helmsmen for certain special maneuvers, such as in tide or river current, for applying high power for turning the boat and speeding the turn while keeping low the longitudinal speed of the boat, and so on, thus further improving the flexibility of the boat control provided by the new marine propulsion unit of the invention.

I claim:

1. In a boat having a bow and a stern and provided with water propelling means including a nozzle adapted to direct a water jet astern of the boat and motor-driven pump means for delivering a stream of pressurized water through said nozzle, a combination comprising steering means including a pair of steerable rudder blades located astern of said nozzle and respectively at opposite lateral sides of the water jet issuing from said nozzle, said blades being pivotable supported in substantial parallel relationship with a given distance therebetween for pivoting movement about substantially vertical axes to either side from a rest position in which said blades extend substantially parallel to a longitudinal plane of symmetry of said nozzle, said blades having trailing and bottom edges defining openings through which the water jet may pass into the surrounding body of water; reversing gate means having a jet-deflecting surface positioned to face the bow and located astern of said nozzle and being movable about an axis transverse to the lengthwise elongation of the boat, said jet-deflecting surface extending over a wider transversal distance than said given distance and being curved downwardly and forwardly, said jet-deflecting surface comprising a central portion having two adjacent arcuate concave sections extending together substantially over said given distance, each of said arcuate sections having their respective centers of curvature in said vertical axes of said blades and defining clearances with said trailing edges of said blades when the latter are in said rest position, and channel-shaped side portions located symmetrically laterally outwardly of said control portion and forming respective channels of generally U-shaped configuration having curved side edges extending forwardly towards said bow; and means for moving said reversing gate means closely adjacent to said trailing edges of said blades between an upper position in which said jet-deflecting surface does not intercept said jet, a plurality of intermediate positions in which said jet-deflecting surface moves to an increasing extent over the opening defined between said trailing edges of said blades so as to force said jet of water to flow at least in part in downward direction through the opening defined between said bottom edges of said blades, and a lower end position in which said jet-deflecting surface forces substantially the entire amount of said jet of water to flow through the opening defined between said bottom edges of said blades, whereby in said lower end position, when said blades are in said rest position, any water escaping laterally through said clearances is directed forwardly in said channels to enhance the reverse thrust and, when said blades are pivoted, the steering action is not attenuated by any water escaping laterally from the clearance at the side of the boat opposite the desired steering direction.

2. A combination as defined in claim 1, wherein said trailing edges of said blades are arcuate-shaped and have their respective centers of curvature in said vertical axes of said blade.

3. A combination as defined in claim 1, wherein said jet-deflecting surface is shaped symmetrically relative to a vertical plane substantially parallel to said longitudinal plane of said nozzle and has a relatively shallow dihedral apex in said plane, said concave sections of said central portion being laterally symmetrically adjacent to said dihedral apex.

4. A combination as defined in claim 3, wherein said trailing edges of said blades are arcuately-curved and sweep adjacently with respect to said concave sections of said central portion when pivoted from said rest position to a position where one of said blades is adjacent said dihedral apex, said clearance defined between said trailing edges and said central portion being constant.

5. A combination as defined in claim 4, wherein said rudder blades consist of plates of resilient material; and further comprising means for stiffening said blades.

6. A combination as defined in claim 5, wherein respective ends of said resilient material plates are integrally formed with resilient extensions which extend forwardly at either side of said nozzle, and said stiffening means is secured to said blades so as to pivot in unison with the latter.

7. A combination as defined in claim 1, said nozzle having a discharge opening for said water jet, and said rudder blades extending downwardly below said discharge opening into said surrounding body of water.

8. A combination as defined in claim 1, wherein said pump means includes a frusto-conically-shaped nozzle lying in said stream for accellerating and propelling said converging jet of water between said rudder blades, wherein said given distance between said blades is greater than the transverse dimension of said jet of water passing between said blades.

* * * * *